United States Patent [19]

Durville et al.

[11] Patent Number: 4,515,186

[45] Date of Patent: May 7, 1985

[54] LOOM HEALD CONTROL MEANS

[75] Inventors: Gerard A. Durville, Gipf-Oberfrik; Robert R. Bucher, Frick, both of Switzerland

[73] Assignee: Textilma Ag, Switzerland

[21] Appl. No.: 506,771

[22] Filed: Jun. 22, 1983

[30] Foreign Application Priority Data

Jul. 1, 1982 [CH] Switzerland ..... 4025/82

[51] Int. Cl.[3] ..... D03C 13/00; D03C 3/08

[52] U.S. Cl. ..... 139/455; 139/65; 139/319; 66/219

[58] Field of Search ..... 139/455, 55.1, 59.60, 139/65, 319, 317; 66/219, 220, 221, 205

[56] References Cited

U.S. PATENT DOCUMENTS

| | | | |
|---|---|---|---|
| 2,204,891 | 6/1940 | Hamilton | 139/455 |
| 3,103,953 | 9/1963 | Lauritsen | 139/455 |
| 3,835,894 | 9/1974 | Speich | 139/455 |
| 4,048,816 | 9/1977 | Scarffe | 66/219 |
| 4,072,175 | 2/1978 | Buran et al. | 139/455 |

FOREIGN PATENT DOCUMENTS

| | | | |
|---|---|---|---|
| 2047755 | 12/1980 | United Kingdom | 139/65 |

*Primary Examiner*—James Kee Chi

*Attorney, Agent, or Firm*—Diller, Ramik & Wight

[57] ABSTRACT

Two rods are provided which are reciprocal between two end positions cooperating with two flexible retaining members, an electromagnet is located between the retaining members, the electromagnet includes a core having two flanged sections of different widths, an armature body each is mounted to the retaining members, the armature bodies are arranged such that they on the one hand abut flatly the border of the two flanged sections and such that on the other hand an air gap is provided between each armature body and the narrower of the flange sections, if the knife moves a rod toward its upper position the retaining member is deflected such to adjust the air gap prevailing between the narrower flange section of the electromagnet and the armature body to a predetermined value, and in operation this control means has two exactly defined control instances during which the deflection of the retained members proceed definitely toward the correct side regarding the function and the power consumption of the electromagnet is thereby extremely low and the heating thereof during operation is decreased.

10 Claims, 7 Drawing Figures

LOOM HEALD CONTROL MEANS

BACKGROUND OF THE INVENTION

1. Field of the Invention

The present invention relates to an improved loom heald control means for operating the warp healds of a loom, specifically of a Jacquard machine, including two rods mounted at one end to the wire, which said two rods are reciprocable between an upper and a lower position, including further flexible rod retaining members supported at one end in a supporting means and operative to retain said rods in their respective end positions, the rods and their corresponding retaining members having complementary shaped engaging sections located at the respective free ends of said rods and said retaining members, which engaging sections are movable into and out of engagement relative to each other, and including an electromagnet located between said retaining members and supported by said supporting means and operative to deflect said retaining members relative to said rods such to move said retaining members into and out of engagement with their respective corresponding rod.

The loom heald control means of a Jacquard machine comprises generally two rods, which are reciprocated by knives and one end of the respective rods is mounted to a wire lid over a set of pulleys and the respective opposite ends of the rods are provided with means operative to retain the rods in a given position. Furthermore, a support means is provided which is movable into and out of engagement with the retaining means at the rods and finally there is provided a control means, with which the rods are moved into engagement and out of engagement with the retaining means.

2. Description of the Prior Art

Such a loom heald control means is disclosed in British Pat. No. 2 047 755, in which the retaining means and control means are combined to a structural unit. This structural unit termed below as control device comprises two flexible retaining members and an electromagnet located between the retaining members and operative to deflect the retaining members relative to the electromagnet and to move the retaining members and the rods into and out of engagement. The retaining members are mounted at one end to a support and the electromagnet projects from the same support and is provided with an exposed core member. The retaining members and rods are provided with a hook and an opening, respectively.

If during operation of the loom one rod is lifted by its corresponding knife, the corresponding retaining member will engage by means of its hook into the opening of the rod and retain the rod in its position as long as the electromagnet is not excited. Upon the excitation of the electromagnet the retaining member will be pulled against the exposed core member of the electromagnet such that the hook provided on the retaining member can no longer engage into mentioned opening.

The drawback of this known design is the necessity of building up a relatively strong magnetic field in order to pull the two retaining members against the core of the electromagnet. Furthermore, the weakening of such magnetic field must be considered, which arises due to the nonsynchronous attraction of the retaining members by the electromagnet and accordingly, premature closing of the magnetic circuit one side of the electromagnet. This presupposes a large output of the electromagnet leading in turn to a higher and undesirable heating thereof. A decrease of the power consumption of the electromagnet by decreasing the air gap is limited because due to the shape of the hook a certain deflecting movement is necessary and also because due to their spring action the retaining members are manufactured from a magnetically hard material having a relatively high remanence.

SUMMARY OF THE INVENTION

Hence, it is a general object of the present invention to provide an improved loom heald control means in which the electromagnet has an I-shaped core and has flange sections of different widths and comprising armature bodies mounted each to the retaining members and located and arranged such that the armature bodies abut on the one hand the broader of the flange sections and on the other hand there is provided an air gap each between the respective armature bodies and the narrower of the flange sections, whereby the retaining members are deflected by the movement of said rods in a direction towards the electromagnet in order to adjust the air gap between the narrower flange section and the armature bodies to a predetermined value.

A further object is to provide an improved loom heald control means allowing an adjusting of the air gap between core and anchor bodies such that the necessary attraction force can be kept at a considerably lower value leading to a relative small electric current necessary for the excitation of the electromagnet and being designed such, that only one retaining member is at a given time operative for the operation of the control means and specifically that retaining member which is allocated to the rod which is being moved in the direction towards the electromagnet.

A further object is to provide a loom heald control means, in which either the rods or the corresponding retaining members are provided with a projection located adjacent one of the complementary shaped engagement sections allowing an adjustment of the air gap between the core of the electromagnet and the armature body to a minimal dimension such that the power consumption of the electromagnet can be reduced to a minimal value.

A further object of the invention is to provide an improved loom heald control means having an armature body made of a magnetically soft material and a retaining member made of a magnetically hard material and comprising, furthermore, a structure made of a nonmagnetizable material which maintains in the deflected position of the retaining member a predetermined distance between the narrower flange section and the armature body. This eliminates the danger of the retaining member not moving back into its rest position upon the de-excitation of the electromagnet and allowing this retaining member to be designed such that it substantially must only cause the restoring movement.

Yet a further object is to provide an improved loom heald control means, in which the retaining member is made of a stainless steel material and biassed such, that in its deflected position it is subject to a restoring force having a nominal value which corresponds to the holding force of the electromagnet and, furthermore, to provide abutment stops on each retaining member. Such allows on the one hand a limiting of the movement of the retaining members in a direction leading away from the electromagnet and on the other hand an advantageous attenuation of the oscillations which will appear during the restoring movement of the retaining members such that an impeccable operation of the loom heald control means is secured.

BRIEF DESCRIPTION OF THE DRAWINGS

The present invention will be more fully understood by reference to the following detailed description thereof when read in conjunction with the attached drawings, and wherein.

DETAILED DESCRIPTION OF THE PREFERRED EMBODIMENT

Figure 1:
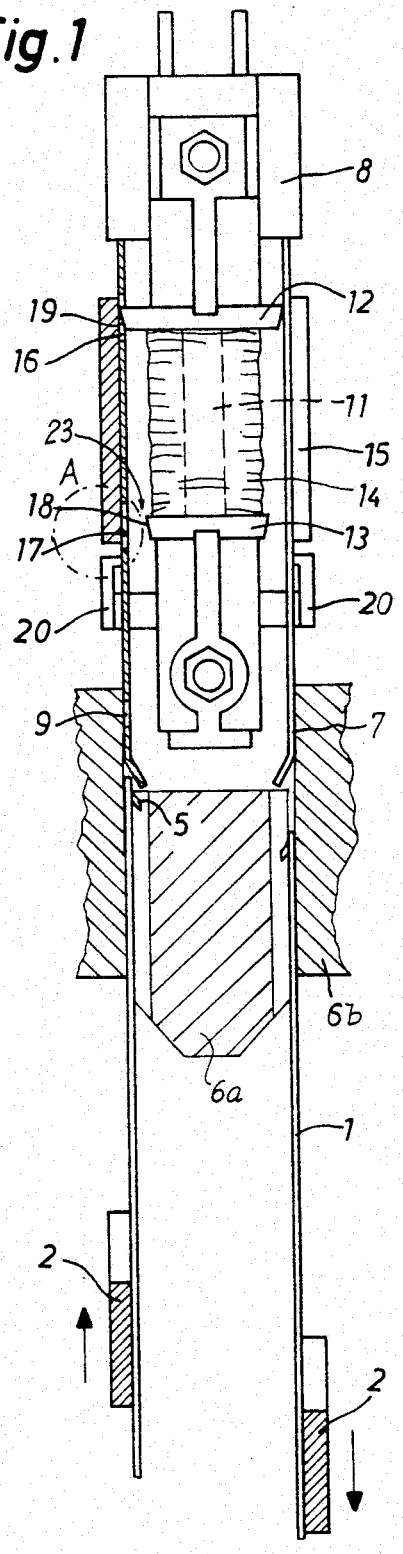
FIG. 1 is a view of a preferred embodiment of the improved loom heald control means illustrated in part in section.

The preferred embodiment which will be described hereinafter will be explained in conjunction with a double-lift-open-shed Jacquard machine. As is clearly illustrated in FIGS. 1–5, the loom heald control means comprises two rods 1 located at a mutual distance from each other, which rods 1 are reciprocated by corresponding knives 2. The rods 1 are mounted in a commonly known way at one end to the wire 3, which is led over the set of pulleys 4 providing in a known way the connection to the warp threads. On the other free end the rods 1 are provided each with a hook 5 and are guided in a guide means *6a, 6b*. According to the illustration in FIG. 1 the rods 1 are guided at both sides by guiding blocks which prevent a deflection of the rods 1 during their movement towards the electromagnet 10.

A retaining member 7 is allocated to every rod 1. These retaining members 7 extend at a distance from each other which corresponds substantially to the distance between the two rods 1 and are, furthermore, molded at one end into a support 8 made of a plastics material and are provided at the other, the free end with an opening 9 allowing an engagement therein of the hook 5 of the corresponding rod 1.

An electromagnet 10 is located between the retaining member 7, which electromagnet 10 is comprised basically of an I-shaped core 11 and rectangular flange sections 12, 13 of different widths and finally of a winding 14. This electromagnet is mounted to the support 8 such that the narrower flange section 13 is located closer to the free end of the respective retaining members 7.

Armature bodies 15 are mounted to the side surface of the retaining members 7 facing away from the electromagnet 10, which armature bodies 15 are arranged such that they abut on the one hand the broader flange section 12 and on the other hand that an air gap is present between the retaining members 7 including their armature bodies 15 and the narrower flange section 13. To this end the retaining members 7 are provided with through holes 16, 17.

The circumferential outer side surfaces 18, 19 of the flange sections 12, 13 which face the armature bodies 15 are arranged such that they extend in a common plane such that the armature bodies 15 can abut flatly the surfaces 18, 19 of the flange sections 12.

Figure 6:
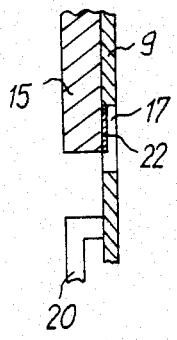
FIG. 6 is the detail "A" of FIG. 1 designed on an enlarged scale.

The retaining members 7 are made from a magnetically hard material, for instance, a stainless steel spring and the armature bodies 15 are made from a magnetically soft material, for instance, of soft iron or mild steel. In order to keep the remanence of the retaining member 7 at a small value a foil 22 made from a not magnetizable material is mounted to a surface area of the armature body 15 which faces the surface area 18 of the narrower flange section 13 such as illustrated in FIG. 6.

Alternatively, there may be provided an abutment stop 23 performed at the retaining member such as shown in FIG. 1.

The support 8 is provided with two abutment stops 20 mounted thereto which form two oppositely located abutments for the retaining members 7.

The retaining member 7 made from a stainless steel spring is mounted in a prestressed condition such that in its deflected state the retaining member 7 is subject to a restoring force which is sized depending from the attraction force of the electromagnet 10 and the retaining member 7 is shaped such, furthermore, that it abuts flatly the abutment areas of the abutment stops 20 in its restored position.

The operation of the above described preferred embodiment will now be explained with reference to FIGS. 2–5.

Figure 2:
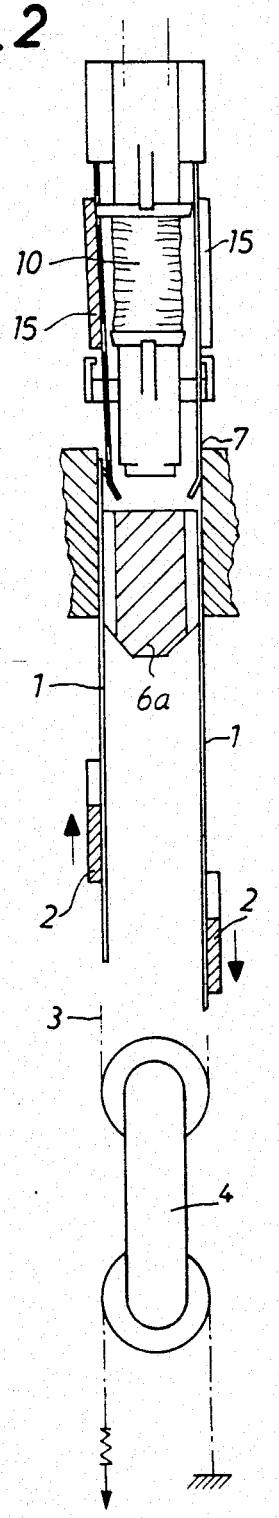
FIGS. 2–5 are illustrations of the loom heald control means of FIG. 1 in various operating positions.
Figure 7:
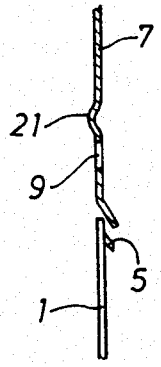
FIG. 7 is a modification of the preferred embodiment illustrated in FIG. 1.
Figure 3:
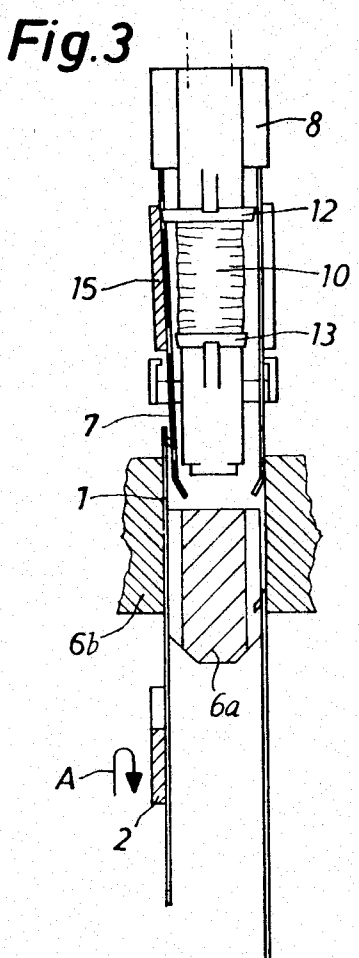

The operational position illustrated in FIG. 2, according to which Figure the knife 2 located at the left hand side is already raised somewhat and the other knife 2 located at the right hand side is already lowered somewhat. As illustrated in this Figure the rod 1 contacts in this position its retaining member 7 and accordingly, the retaining member 7 is already deflected. This deflection of the retaining member 7 is maintained until rod 1 has reached its upper end position such as shown in FIG. 3. In this position the air gap prevailing between the armature body 15 and the surface area 18 of the narrower flange section 13 is adjusted to a predetermined value, and now the knife 2 will be lowered.

Figure 4:
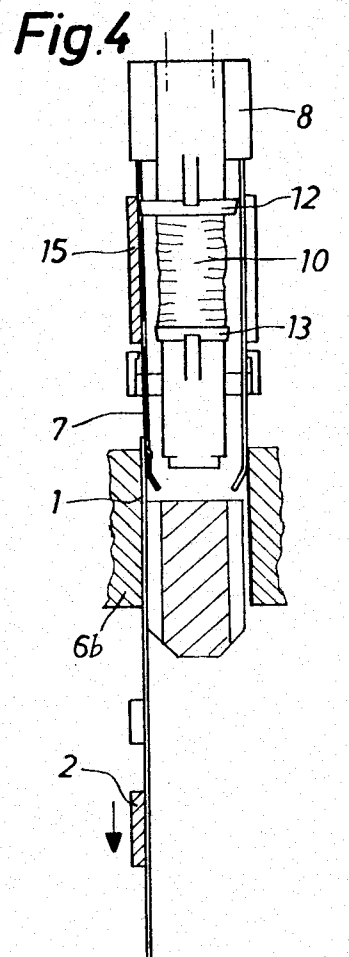

If the electromagnet 10 is not excited, the hook 5 located on the rod 1 will engage into the opening 9 of the retaining member 7 during the lowering of the knife 2 and accordingly will retain rod 1 in its position although the knife is continuously lowered further, such as shown in FIG. 4.

Figure 5:
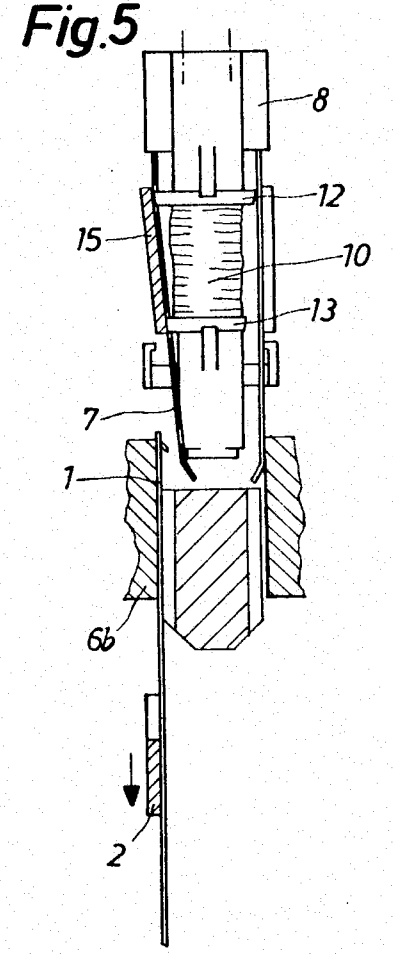

If, however, the electromagnet 10 is excited, the armature body 15 is attracted due to the magnetic field against the surface area 18 of the narrower flange section 13. In such case the armature body 15 will flatly abut the surface areas 19 of both flange sections 12, and the foil 22 located on the surface section 18 of the narrower flange section 13 or the retaining member 7, respectively, contacts the abutment stop 23. This causes a further deflecting of the retaining members 7 such as shown in FIG. 5. The rod 1 which is being lowered cannot engage by means of its hook 5 into the opening 9 of the retaining member 7 and accordingly will be lowered down into its other end position.

Such as illustrated in FIG. 5 the other retaining member 7 is not deflected, also in such case when the electromagnet 10 is excited. The deflection will occur in such case not earlier before this retaining member 7 has been deflected by its corresponding (not particularly shown) rod to such an extent that the air gap existing between the surfaces of the flange sections 13 and the armature body 15 has reached a predetermined value.

Above explanation discloses clearly that in comparison with previous control means this above described control means operates with two exactly defined control timing points, in which the deflection of the retaining element 7 proceeds definitely at the proper side regarding the operation.

In FIG. 6 there is shown a modified embodiment of the retaining member 7. A projection 21 is provided aside of the opening 9 of this retaining member 7, which projection will contact hook 5 during the raising movement of rod 1. This will allow a decrease of the dimension of the air gap. In such case the magnetic field generated by the electromagnet can be reduced further.

While there are shown and described present preferred embodiments of the invention, it is to be distinctly understood that the invention is not limited thereto, but may be otherwise variously embodied and practiced within the scope of the following claims. Accordingly,

What is claimed is:

1. An improved loom heald control means for operating the warp healds of a loom, specifically of a Jacquard machine, including two rods mounted at one end to the wire, which said two rods are reciprocable between an upper and a lower position, including further flexible rod retaining members supported at one end in a supporting means and operative to retain said rods in their respective end positions, the rods and their corresponding retaining members having complementary shaped engaging sections located at the respective free ends of said rods and said retaining members, which engaging sections are movable into and out of engagement relative to each other, and including an electromagnet located between said retaining members and supported by said supporting means and operative to deflect said retaining members relative to said rods such to move said retaining members into and out of engagement with their respective corresponding rod, the improvement comprising an I-shaped core of said electromagnet having flange sections of differing widths, comprising further armature bodies mounted each to said retaining members and located and arranged such that said armature bodies abut on the one hand the broader of said flange sections and on the other hand there is provided an air gap each between the said respective armature bodies and the narrower of said flange sections, whereby said retaining members are deflectable by the movement of said rods in a direction towards said electromagnet in order to adjust said air gap between said narrower flange section and said armature bodies to a predetermined value.

2. The improvement of claim 1, in which either the rods or their corresponding retaining members are provided with a projection, such projection located adjacent one of said complementary shaped engagement sections and allowing an adjustment of said air gap between said narrower flange section of said electromagnet and said armature bodies to a predetermined value.

3. The improvement of claim 1, in which said armature bodies are mounted to a side surface of said retaining members facing away from said electromagnet and in which said retaining members are provided with through holes operative to allow a contact between said armature bodies and said flange sections.

4. The improvement of claim 3, in which said armature bodies are made of a magnetically soft material and said retaining members are made of a magnetically hard material, and in which there is provided a structure made of a not magnetizable material providing in the deflected state of said retaining members a predetermined distance between said narrower electromagnet flange section and said respective armature bodies such to keep the remanence of said retaining members at a low value.

5. The improvement of claim 4, in which said not magnetizable structure comprises a foil mounted either to said respective armature bodies or to the surface of said narrower electromagnet flange section.

6. The improvement of claim 4, in which said not magnetizable structure is an abutment stop located on said supporting means.

7. The improvement of claim 4, in which said retaining members are made of a stainless steel spring and are biassed such that in their deflected position they are subject to a restoring force having a nominal value which corresponds to the retaining force of said electromagnet.

8. The improvement of claim 1, in which the circumferential outer surfaces of said flange sections of said electromagnet facing said armature bodies define a common plane such that said retaining elements including their armature bodies abut in their deflected positions both said outer flange section surfaces completely and flatly.

9. The improvement of claim 1, in which said retaining members are provided with an abutment member each such to limit the extent of the movement thereof leading away from said electromagnet.

10. The improvement of claim 1, comprising a rod guiding means preventing said rods from deflecting during their movement leading towards said electromagnet.

* * * * *